US007350569B2

(12) United States Patent
Collins et al.

(10) Patent No.: US 7,350,569 B2
(45) Date of Patent: Apr. 1, 2008

(54) SEPARABLE PLUG FOR USE IN A WELLBORE

(75) Inventors: Ronald B. Collins, Edmonton (CA); Wayne Richard Jolly, Ardrossan (CA)

(73) Assignee: Weatherford/Lamb, Inc., Houston, TX (US)

( * ) Notice: Subject to any disclaimer, the term of this patent is extended or adjusted under 35 U.S.C. 154(b) by 317 days.

(21) Appl. No.: 11/063,516

(22) Filed: Feb. 23, 2005

(65) Prior Publication Data

US 2005/0274518 A1 Dec. 15, 2005

Related U.S. Application Data

(63) Continuation-in-part of application No. 10/867,389, filed on Jun. 14, 2004, now Pat. No. 7,185,700.

(51) Int. Cl.
*E21B 47/01* (2006.01)
*E21B 17/06* (2006.01)

(52) U.S. Cl. ..... 166/254.2; 166/66; 166/242.6

(58) Field of Classification Search ..... 166/254.2, 166/242.7, 242.6, 242.2, 241.6, 241.7, 255.2, 166/250.11, 381, 301, 98, 387, 69, 117
See application file for complete search history.

(56) References Cited

U.S. PATENT DOCUMENTS 2,839,142 A * 6/1958 Huber ..... 166/297
3,000,443 A * 9/1961 Thompson ..... 166/135
3,097,696 A * 7/1963 Orr ..... 166/135
3,559,905 A 2/1971 Palynchuk
4,064,939 A * 12/1977 Marquis ..... 166/254.2
4,349,072 A 9/1982 Escaron et al.
4,457,370 A 7/1984 Wittrisch
4,460,038 A 7/1984 Clamens
4,484,628 A 11/1984 Lanmon, II
4,583,592 A * 4/1986 Gazda et al. ..... 166/250.07
4,600,055 A 7/1986 Durst et al.
4,682,657 A 7/1987 Crawford
4,708,202 A 11/1987 Sukup et al.
4,794,791 A 1/1989 Wittrisch
5,042,297 A 8/1991 Lessi (Continued)

FOREIGN PATENT DOCUMENTS

FR 2 652 160 3/1991

(Continued)

OTHER PUBLICATIONS

GB Partial Search Report, Application No.: 0603389.8, Dated Jun. 13, 2006.

(Continued)

*Primary Examiner*—Kenneth Thompson
(74) *Attorney, Agent, or Firm*—Patterson & Sheridan, LLP

(57) ABSTRACT

The invention generally relates to an apparatus and a method for conveying and operating tools in a wellbore. In one aspect, a method of performing an operation in a wellbore is provided. The method includes running a selectively separable plug member accommodating a tool into the wellbore on a continuous rod and positioning the separable plug member adjacent a receiver member disposed in the wellbore. The method further includes manipulating the weight of the continuous rod to seat the separable plug member in the receiver member. In another aspect, a plug assembly for use in a wellbore is provided.

21 Claims, 7 Drawing Sheets

U.S. PATENT DOCUMENTS

| | | | | |
|---|---|---|---|---|
| 5,080,175 | A | | 1/1992 | Williams |
| 5,172,765 | A | | 12/1992 | Sas-Jaworsky et al. |
| 5,184,682 | A | | 2/1993 | Delacour et al. |
| 5,194,859 | A | * | 3/1993 | Warren ..... 340/853.4 |
| 5,217,075 | A | | 6/1993 | Wittrisch |
| 5,234,058 | A | | 8/1993 | Sas-Jaworsky et al. |
| 5,259,451 | A | * | 11/1993 | Kent et al. ..... 166/163 |
| 5,348,097 | A | | 9/1994 | Giannesini et al. |
| 5,505,259 | A | | 4/1996 | Wittrisch et al. |
| 5,584,512 | A | * | 12/1996 | Carstensen ..... 285/55 |
| 5,608,214 | A | | 3/1997 | Baron et al. |
| 5,636,686 | A | | 6/1997 | Wittrisch |
| 5,749,417 | A | | 5/1998 | Delatorre |
| 6,098,713 | A | | 8/2000 | Ross |
| 6,157,761 | A | | 12/2000 | Wittrisch |
| 6,173,787 | B1 | | 1/2001 | Wittrisch |
| 6,179,058 | B1 | | 1/2001 | Wittrisch |
| 6,575,241 | B2 | | 6/2003 | Widney et al. |
| 2003/0090390 | A1 | | 5/2003 | Snider et al. |

FOREIGN PATENT DOCUMENTS

| | | |
|---|---|---|
| GB | 2281088 | 2/1995 |
| GB | 2301606 | 12/1996 |
| GB | 2415445 | 12/2005 |

OTHER PUBLICATIONS

GB Search Report, Application No. 0603389.8, Dated Feb. 14, 2007.

* cited by examiner

SEPARABLE PLUG FOR USE IN A WELLBORE

CROSS-REFERENCE TO RELATED APPLICATIONS

This application is a continuation-in-part of U.S. patent application Ser. No. 10/867,389, filed Jun. 14, 2004, now U.S. Pat. No. 7,185,700 which is herein incorporated by reference in its entirety.

BACKGROUND OF THE INVENTION

1. Field of the Invention

The present invention generally relates to an apparatus and a method for conveying and operating tools in a wellbore. More particularly, the invention relates to a separable plug for use with a wellbore tool.

2. Description of the Related Art

In the drilling of oil and gas wells, a wellbore is formed using a drill bit that is urged downwardly at a lower end of a drill string. After drilling a predetermined depth, the drill string and the drill bit are removed, and the wellbore is lined with a string of steel pipe called casing. The casing provides support to the wellbore and facilitates the isolation of certain areas of the wellbore adjacent hydrocarbon bearing formations. An annular area is thus defined between the outside of the casing and the earth formation. This annular area is typically filled with cement to permanently set the casing in the wellbore and to facilitate the isolation of production zones and fluids at different depths within the wellbore. Numerous operations occur in the well after the casing is secured in the wellbore. All operations require the insertion of some type of instrumentation or hardware within the wellbore. For instance, wireline logging tools are employed in the wellbore to determine various formation parameters including hydrocarbon saturation.

Early oil and gas wells were typically drilled in a vertical or near vertical direction with respect to the surface of the earth. As drilling technology improved and as economic and environmental demands required, an increasing number of wells were drilled at angles which deviated significantly from vertical. In the last several years, drilling horizontally within producing zones became popular as a means of increasing production by increasing the effective wellbore wall surface exposed to the producing formation. It was not uncommon to drill sections of wellbores horizontally (i.e. parallel to the surface of the earth) or even "up-hill" where sections of the wellbore were actually drilled toward the surface of the earth.

The advent of severely deviated wellbores introduced several problems in the performance of some wellbore operations. Conventional logging was especially impacted. Conventional logging utilizes the force of gravity to convey logging instrumentation into a wellbore. Gravity is not a suitable conveyance force in highly deviated, horizontal or up-hill sections of wellbores. Numerous methods have been used, with only limited success, to convey conventional instrumentation or "tools" in highly deviated conditions. These methods include the use of conveyance members such as electric wireline, slickline, coiled tubing, or jointed pipe.

Electric wireline or "wireline" is generally a multi-strand wire or cable for use in oil or gas wells. The non-conductive cables provide structural support for the single conductor cable during transport of the wireline into the wellbore. In a logging operation, a logging tool is attached to the wireline and then the tool string is either lowered into the wellbore utilizing the force of gravity or pulled into the wellbore by a tractor device. A slickline is generally a single-strand non-conductive wire with an outer diameter between 5/16" to 3/8". Due to the slickline's small diameter (particularly in relation to typical wellbore diameters) and hence minimal columnar buckling resistance, slickline cannot be pushed or urged into the wellbore, but rather slickline must rely on utilizing the force of gravity.

Coiled tubing is a long continuous length of spooled or "reeled" thin walled pipe. Coiled tubing can be "pushed" into a wellbore more readily than wireline or slickline but still has limitations. Coiled tubing units utilize hydraulic injector heads that push the coiled tubing from the surface, allowing it to reach deeper than slickline, but ultimately the coiled tubing stops as well. Coiled tubing is susceptible to a condition known as lockup. As the coiled tubing goes through the injector head, it passes through a straightener; but the tubing retains some residual bending strain corresponding to the radius of the spool. That strain gives the tubing a helical form when deployed in a wellbore and can cause it to wind axially along the wall of the wellbore like a long, stretched spring. Ultimately, when a long enough length of coiled tubing is deployed in the well bore, frictional forces from the wellbore wall rubbing on the coiled tubing cause the tubing to bind and lock up, thereby stopping its progression. Such lock up limits the use of coiled tubing as a conveyance member for logging tools in highly deviated, horizontal, or up-hill sections of wellbores.

Jointed pipe has been used for the deployment of certain downhole devices even where "pushing" is required. In a given diameter range jointed pipe has greater buckling resistance than any of wireline, slickline, or coiled tubing. Each threaded connection (typically every thirty feet) in a string of jointed pipe acts as a column stiffener and upset threaded connections also tend to stand the bulk of the pipe away from the wall of the wellbore thereby reducing cumulative frictional engagement. Jointed pipe is deficient in that it requires a rig (including some form of derrick or crane) for deployment and deployment is very time consuming. Each threaded connection must be made and unmade when correspondingly deploying or retrieving jointed pipe. The additional time consumption and the logistics of moving a rig onto a work location make the use of jointed pipe very expensive as compared with reeled deployment options such as wireline, slickline, and coiled tubing.

Another problem that can adversely affect logging in a wellbore arises when the wellbore contains a high percentage of water relative to the hydrocarbons in the surrounding formations. In this situation, fluid tends to collect and remain static in the lowest point of the wellbore because there is not enough hydrocarbon formation pressure to move the fluid. For instance, fluid tends to collect at a junction between a vertical portion and a deviated portion in a deviated wellbore. Without fluid flow, production logging tools can not operate properly to collect data. To overcome this problem, some form of artificial lift is typically employed to move fluids through the wellbore, such as a submersible pump. The increased velocity of the fluid provides an adequate flow rate for the logging tool to operate.

Generally, the submersible pump is run into the wellbore on production tubing with a Y block between the production tubing and the submersible pump. The Y block allows the pump to be turned on and the well produced while leaving an access point to the lower wellbore for logging tools. Typically, the access point is a smaller string of tubing attached to the Y block which is run along side the submersible pump. In operation, a logging tool is conveyed through the production tubing attached to a string of coiled tubing. As the logging tool passes through the Y block and the smaller string of tubing, a plug attached to the string of coiled tubing lands in a seat formed in the smaller string of tubing. The plug seals off an annular area formed between the coiled tubing and the smaller string of tubing while allowing the string of coiled tubing and the logging tool to continue to travel into the wellbore. Although coiled tubing may be used in deviated wellbores, the coiled tubing presents many drawbacks, such as "bind and lock up" as discussed above. Moreover, the drawbacks of coiled tubing are further complicated in some deep and highly deviated wells, where it may not be possible to provide the required downward force to the downhole components by "pushing" the coiled tubing string (i.e., loading the coiled tubing in compression) from the surface.

A need therefore exists for a reliable and operationally efficient system to convey and operate wellbore tools in wellbores which are deviated from the vertical.

SUMMARY OF THE INVENTION

The invention generally relates to an apparatus and a method for conveying and operating tools in a wellbore. In one aspect, a method of performing an operation in a wellbore is provided. The method includes running a selectively separable plug member accommodating a tool into the wellbore on a continuous rod and positioning the separable plug member adjacent a receiver member disposed in the wellbore. The method further includes manipulating the weight of the continuous rod to seat the separable plug member in the receiver member.

In another aspect, a method of performing an operation in a wellbore is provided. The method includes running a selectively actuatable plug member into the wellbore on a tubular member, wherein the plug member accommodates at least one tool. The method further includes actuating the plug member by manipulating the weight of the continuous solid rod, thereby separating a first portion of the plug member from a second portion. Additionally, the method includes using the tubular member to run the second portion with the at least one tool to a predetermined location below the first portion to perform the operation.

In yet another aspect, a plug assembly for use in a wellbore is provided. The apparatus includes a first portion configured to be attachable to a solid continuous rod, wherein the first portion having a plurality of setting rings constructed and arranged to expand upon application of a force. The apparatus further includes a second portion configured to accommodate at least one wellbore tool. Additionally, the apparatus includes a selectively actuatable member for connecting the first portion to the second portion, whereby the selectively actuatable member allows the second portion to separate from the first portion upon application of a predetermined force.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
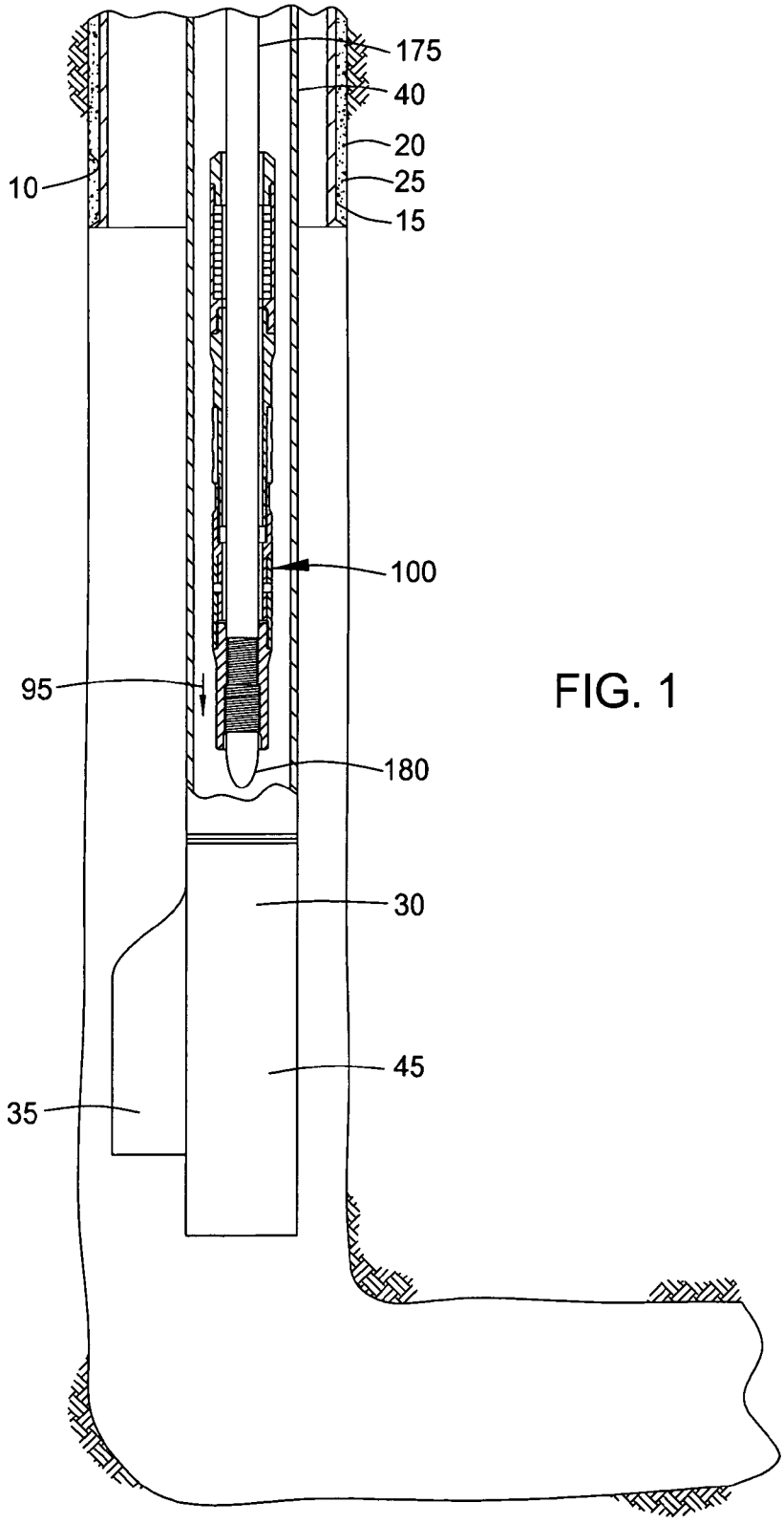
FIG. 1 is a sectional view illustrating a tool and a plug assembly being lowered into a wellbore on a continuous rod.

In general, the present invention relates to a selectively actuated logging plug for use with a continuous rod, such as a COROD string. Typically, a continuous sucker rod or COROD string is made from a metal, such as steel, having a solid round cross section or near solid cross section having for example at least a ⅝" outer diameter. While the outer diameter dimensions may vary, the relatively small diameter to thickness ratios of COROD is distinctive. For solid cross section COROD the diameter to thickness ratio can be stated as equaling 2 (taking thickness from the cross section centerline). For COROD with a small inner diameter such as ⅛" and an outer diameter of 1⅛" the diameter to thickness ratio could be stated as equaling 2.25. If the inner diameter of such a 1⅛" COROD were larger than ⅛" the diameter to thickness ratio would increase correspondingly. The diameter to thickness ratios for COROD is however significantly less than those for coiled tubing for which the ratios are typically 15 and higher. Unlike a jointed sucker rod which is made in specific lengths and threaded at each end for sequential connection of those lengths, COROD is made in one continuous length and placed on a reel. Because COROD has fairly low diameter to thickness ratios (often equaling 2 as previously discussed), such reeling does not impart any significant ovality to the COROD. Further the COROD diameter in relation to the diameter or apparent diameter of the reel is such that residual bending strain in the COROD is minimized or eliminated. As such the COROD retains its buckling resistance characteristics when deployed into a wellbore. Unlike wireline or slickline, COROD can be "pushed" into a wellbore and unlike coiled tubing it can be pushed further because it doesn't tend to helix within the wellbore. Also, because COROD has material across a substantial portion of its cross section it retains relatively high tensile and compressive strength under axial loading as well as internal or external differential pressure. COROD is superior to jointed pipe because it can be deployed using a more cost effective and logistically versatile system and in a more time efficient manner.

The COROD string works equally well in vertical and highly deviated wells. The COROD can be used for multiple runs into a well or wells with no fatigue because unlike coiled tubing it is not plastically deformed when cycled on and off the reel. The COROD string can be run through tubing thereby eliminating the additional cost and time required to deploy a jointed pipe, or tractor conveyed systems. When the COROD string is used in logging operations, the downhole tools record data of interest in memory within the downhole tool rather than telemetering the data to the surface as in conventional wireline logging. Data is subsequently retrieved from memory when the tool is withdrawn from the wellbore. The tool position in the wellbore is synchronized with a depth encoder, which is preferably at the surface near a COROD injector apparatus. The depth encoder measures the amount of COROD string within the well at any given time. Data measured and recorded by the downhole tool is then correlated with the depth encoder reading thereby defining the position of the tool in the well. This information is then used to form a "log" of measured data as a function of depth within the well at which the data is recorded. It is also noteworthy that the COROD string for conveying equipment is not limited to oil and gas well applications. It is equally applicable to use in a pipeline where pipeline inspection services are run. To better understand the novelty of the apparatus of the present invention and the methods of use thereof, reference is hereafter made to the accompanying drawings.

FIG. 1 is a sectional view illustrating a tool 180 and a plug assembly 100 being lowered into a deviated wellbore 10 on a continuous string, such as a COROD string 175 or tubular member. For purposes of discussion, the wellbore 10 is illustrated as a deviated wellbore. It should be understood, however, that the plug assembly 100 may be employed in a vertical wellbore, without departing from principles of the present invention. Additionally, the tool conveyance member described herein relates to the COROD string 175, however the present invention may be employed with other types of conveyance members, such a tubular member or coiled tubing.

As illustrated, the wellbore 10 is lined with a string of steel pipe called casing 15. The casing 15 provides support to the wellbore 10 and facilitates the isolation of certain areas of the wellbore 10 adjacent hydrocarbon bearing formations. The casing 15 typically extends down the wellbore 10 from the surface of the well to a designated depth. An annular area 20 is thus defined between the outside of the casing 15 and the wellbore 10. This annular area 20 is filled with cement 25 pumped through a cementing system (not shown) to permanently set the casing 15 in the wellbore 10 and to facilitate the isolation of production zones and fluids at different depths within the wellbore 10. Subsequently, a submersible pump 35 is run into the wellbore 10 on a production tubing 40 with a Y-block 30 between the production tubing 40 and the submersible pump 35. The Y block 30 allows the pump 35 to be turned on and the well produced while leaving an access point to the wellbore 10 for logging tools. Typically the access point is an instrument tube 45 positioned adjacent the submersible pump 35 and attached to the Y block 30.

After the submersible pump 35 and the production tubing 40 are positioned in the wellbore 10, the plug assembly 100 and the tool 180 are lowered through the production tubing 40 on the COROD string 175 in the direction indicated by arrow 95. Generally, the COROD string 175 is lowered into the wellbore 10 by an injector apparatus (not shown). The injector apparatus typically includes a depth encoder (not shown) to record the amount of COROD string 175 within the wellbore 10 at any given time thereby determining the position of the tool 180 within the wellbore 10. Additionally, the depth encoder may be used to determine the location of the plug assembly 100 in relation to the instrument tube 45 as the plug assembly 100 is lowered through the production tubing 40.

Figure 2:
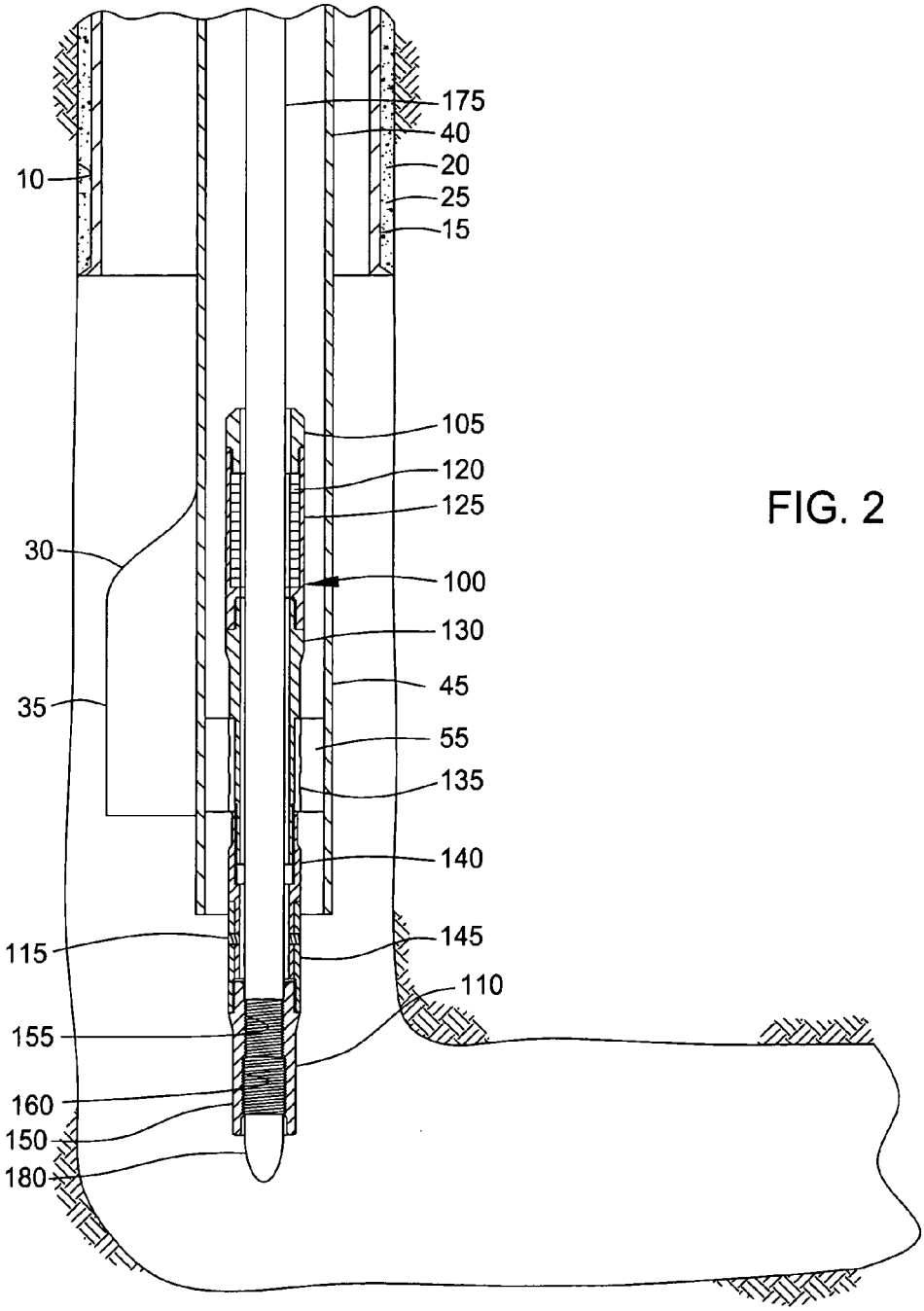
FIG. 2 is a sectional view illustrating the plug assembly being positioned in a receiver member.

FIG. 2 is a sectional view illustrating the plug assembly 100 being positioned in a receiver member 55. The plug assembly 100 generally comprises a first portion 105 and a second portion 110. The first and second portions 105, 110 are operatively attached to each other by a selectively actuated release member 115. The release member 115 is a device that operates at a predetermined pressure or force. In one embodiment, the release member 115 is a shear bolt or shear pin disposed between the first portion 105 and the second portion 110 as illustrated in FIG. 2. The shear bolt is constructed and arranged to fail at a predetermined axial force. Generally, the shear bolt is a short piece of brass or steel that is used to retain sliding components in a fixed position until sufficient force is applied to break the bolt. Once the bolt is sheared, the components may then move to operate the tool. The shear bolt has a predetermined breaking value that can be adjusted by using different diameter shear bolt.

Alternatively, other forms of shearable members may be employed in the release member 115, as long as they are capable of shearing at a predetermined force. For example, a threaded connection (not shown) may be employed between the first portion 105 and the second portion 110. Generally, the threads machined on the first portion 105 are mated with threads machined on the second portion 110 to form the threaded connection. The threads on the first portion 105 and the second portion 110 are machined to a close fit tolerance. The threads are constructed and arranged to fail or shear when a predetermined axial force is applied to the plug assembly 100. The desired axial force required to actuate the release member 115 determines the quantity of threads and the thread pitch.

The first portion 105 includes a pressure activated ring 120 substantially enclosed in a housing 125 at an upper end thereof. The pressure activated ring 120 creates and maintains a seal around the COROD string 175 during deployment of tool 180. The ring 120 is pressure activated, whereupon the application of a predetermined pressure in the production tubing 40 a sealing relationship is formed between the plug assembly 100 and the COROD string 175. In one embodiment, the ring 120 is constructed from an elastomeric material.

Adjacent the housing 125 is an upper mandrel 130 with a ring member 135 disposed around the outer surface thereof. The ring member 135 secures and seals the first portion 105 within the instrument tube 45. The ring member 135 includes a plurality of profiles formed on the outer surface thereof that mate with a receiver member 55 formed in the instrument tube 45. After the ring member 135 mates with the receiver member 55, a sealing relationship is formed between the plug assembly 100 and the instrument tube 45. If there is no sealing relationship between the plug assembly 100 and the instrument tube 45, the pump 35 will only circulate fluid around the Y-block 30 rather than pumping fluid up the production tubing 40. In one embodiment, the ring member 135 is constructed from a fiber material.

The first portion 105 further includes a lower mandrel 140 attached to the upper mandrel 130 through a connection member, such as a lock nut assembly. Additionally, the lower mandrel 140 is operatively attached to a housing 145 on the second portion 110 by the selectively actuated release member 115.

Adjacent the housing 145 in the second portion 110 is a connector 150. The connector 150 includes a first threaded portion that mates with a threaded portion on the COROD string 175 to form a threaded connection 155 which connects the plug assembly 100 to the COROD string 175. The connector 150 includes a second threaded portion that mates with a threaded portion on the tool 180 to form a threaded connection 160 which connects the plug assembly 100 to the tool 180. It should be understood, however, that COROD string 175 and the tool 180 may be connected to the plug assembly 100 by any type of connection member, without departing from principles of the present invention.

As illustrated in FIG. 2, the plug assembly 100 is urged through the production tubing 40 and the Y-block 30 into instrument tube 45 until the ring member 135 contacts the receiver member 55 formed in the instrument tube 45. At that point, the ring member 135 mates with the receiver member 55 to form a seal between the plug assembly 100 and the instrument tube 45. As the COROD string 175 continues to be urged downward, a force is created on the release member 115. At a predetermined force, the release member 115 actuates, thereby allowing the second portion 110 of the plug assembly 100 and the tool 180 to move in relation to the first portion 105 of the plug assembly 100 which is secured in the instrument tube 45.

Figure 3:
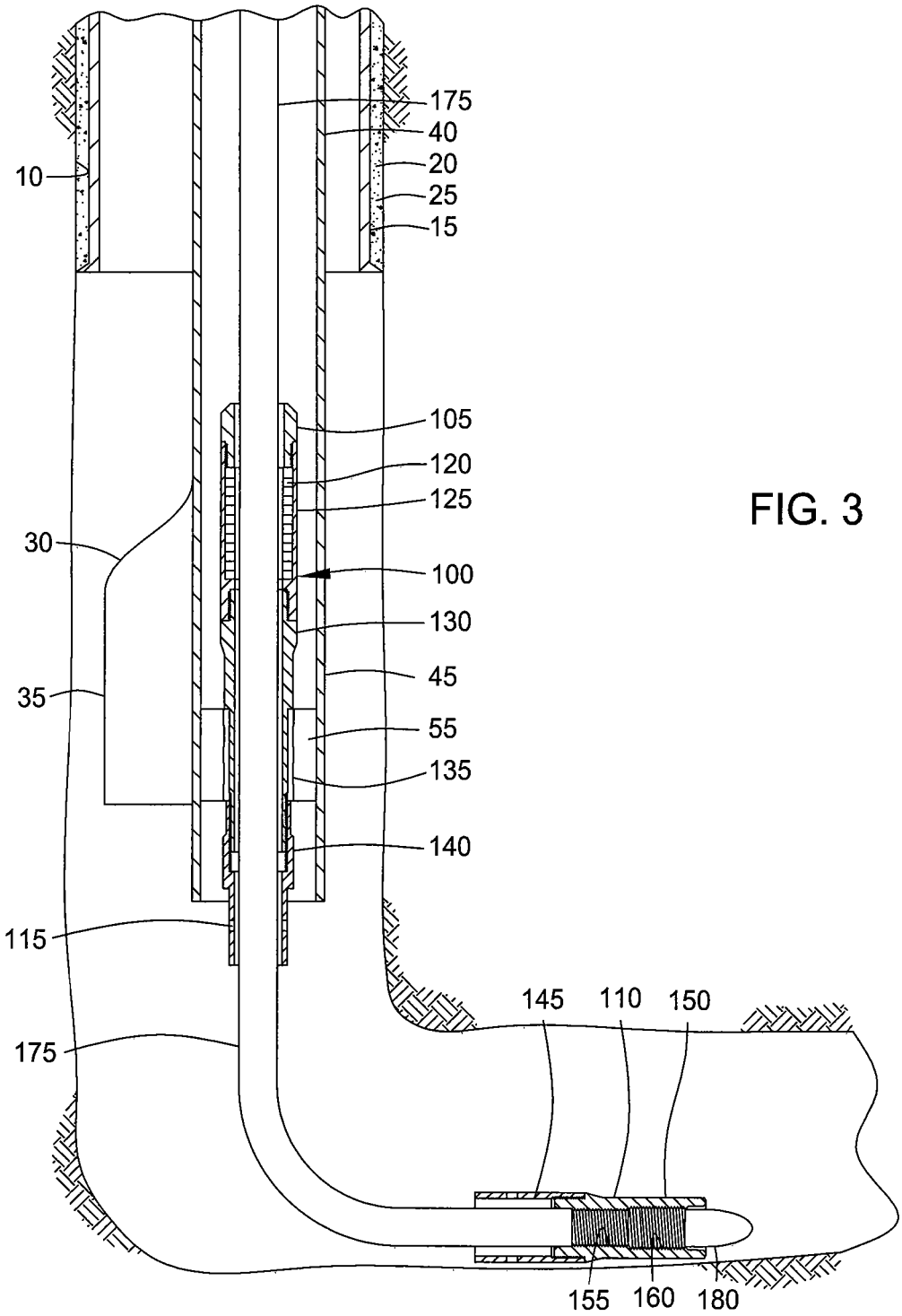
FIG. 3 is a sectional view illustrating the tool being urged through the wellbore after the plug assembly has been actuated.

FIG. 3 is a sectional view illustrating the tool 180 being urged through the wellbore 10 after the plug assembly 100 has been actuated. For purposes of discussion, assume the tool 180 is a logging tool. It is to be understood, however, that the tool 180 may be any type of wellbore tool without departing from principles of the present invention, such as a casing perforating "gun" for perforating the casing 15 in a formation zone of interest. The tool 180 may also be a casing inspection tool, or a production logging tool to measure the amount and type of fluid flowing within the casing 15 or within production tubing 40. The tool 180 can also be a fishing tool that is used to retrieve unwanted hardware from the wellbore 10, such as an overshot or a spear. It should be further noted that the tool 180 need not be retrieved when the COROD string 175 is withdrawn from the wellbore 10. As an example, the tool 180 could be a packer or a plug, which is left positioned within the borehole when the COROD string 175 is withdrawn. Thus, the COROD string 175 is suitable for delivering or operating completions tools.

As shown in FIG. 3, the COROD string 175 continues to urge the second portion 110 along with the tool 180 through the deviated portion of the wellbore 10 to conduct a logging operation. At the same time, the pressure activated ring 120 maintains a seal around the COROD string 175 and the ring member 135 maintains a seal between the plug assembly 100 and the instrument tube 45.

In one embodiment, the tool 180 contains a sensor package (not shown) which responds to formation and wellbore parameters of interest. The sensors can be nuclear, acoustic, electromagnetic, or combinations thereof. Response data from the sensor package is recorded in a memory member (not shown) for subsequent retrieval and processing when the tool 180 is withdrawn from the wellbore 10. A power supply (not shown), which is typically a battery pack, provides operational power for the sensor package and memory member. As the data is retrieved from the memory, it is correlated with the depth encoder response to form a "log" of measured parameters of interest as a function of depth within the wellbore 10.

In another embodiment, the invention is equally usable with more traditional wireline logging methods dependent upon a conductor to transmit data as logging operations are taking place. The COROD string 175 can be manufactured with a longitudinal bore therethrough to house a conductor (not shown) suitable for transmitting data. In one example, the conductor is placed within the bore of the COROD string 175 prior to rolling the COROD string 175 on a transportation reel (not shown). As the tool 180 and the plug assembly 100 are assembled at one end of the COROD string 175, a mechanical and electrical connection is made between the conductor housed in the COROD string 175 and the tool 180 connected to the end of the COROD string 175 prior to insertion into the wellbore 10. In this manner, the COROD string 175 is used to both carry the tool 180 downhole and transmit data from the tool 180 to the surface of the wellbore 10.

In another embodiment, the COROD string 175 itself can act as a conductor to transmit data to the surface of a wellbore 10. For example, COROD string 175 can be covered with a coating of material (not shown) having the appropriate conductive characteristics to adequately transmit signals from the tool 180. In this manner, no additional conductor is necessary to utilize the tool 180 placed at the end of the COROD string 175.

Additionally, the COROD string 175 can be used to transport logging tools (not shown) that are capable of real time communication with the surface of the well without the use of a conductor. For example, using a telemetry tool and gamma ray tool disposed on the COROD string 175 having various other remotely actuatable tools disposed thereupon, the location of the tools with respect to wellbore zones of interest can be constantly monitored as the telemetry tool transmits real time information to a surface unit. At the surface, the signals are received by signal processing circuits in surface equipment (not shown), which may be of any suitable known construction for encoding and decoding, multiplexing and demultiplexing, amplifying and otherwise processing the signals for transmission to and reception by the surface equipment. The operation of the gamma ray tool is controlled by signals sent downhole from surface equipment. These signals are received by a tool programmer which transmits control signals to the detector and a pulse height analyzer.

The surface equipment includes various electronic circuits used to process the data received from the downhole equipment, analyze the energy spectrum of the detected gamma radiation, extract therefrom information about the formation and any hydrocarbons that it may contain, and produce a tangible record or log of some or all of this data and information, for example on film, paper or tape. These circuits may comprise special purpose hardware or alternatively a general purpose computer appropriately programmed to perform the same tasks as such hardware. The data/information may also be displayed on a monitor and/or saved in a storage medium, such as disk or a cassette.

The electromagnetic telemetry tool generally includes a pressure and temperature sensor, a power amplifier, a downlink receiver, a central processing unit, and a battery unit. The electromagnetic telemetry tool is selectively controlled by signals from the surface unit to operate in a pressure and temperature sensing mode, providing for a record of pressure versus time or a gamma ray mode which records gamma counts as the apparatus is raised or lowered past a correlative formation marker. The record of gamma counts is then transmitted to surface and merged with the surface system depth/time management software to produce a gamma ray mini log which is later compared to the wireline open-hole gamma ray log to evaluate the exact apparatus position. In this manner, components, including packers and bridge plugs can be remotely located and actuated in a wellbore using real time information that is relied upon solely or that is compared to a previously performed well log.

Figure 4:
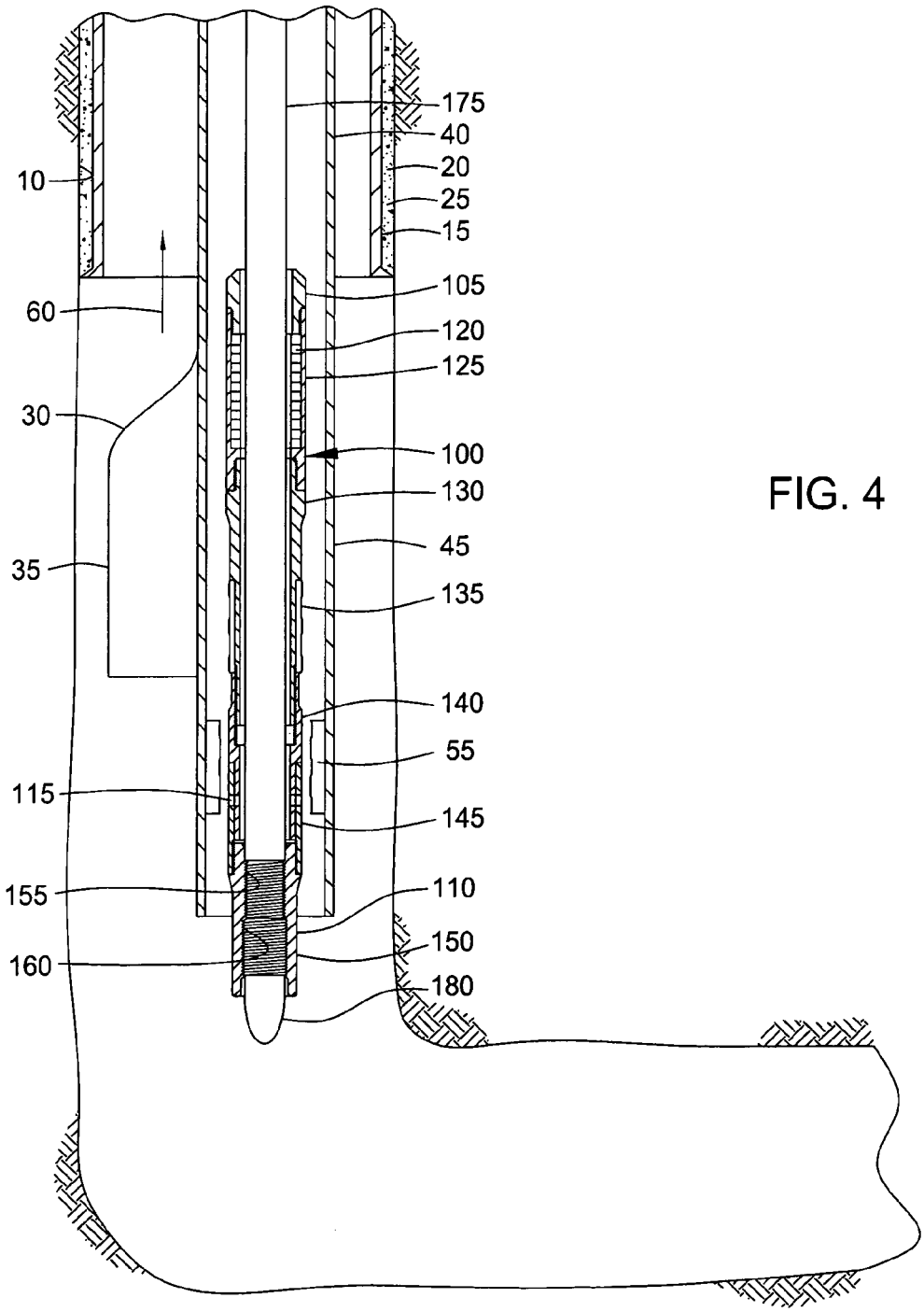
FIG. 4 is a sectional view illustrating the tool and the plug assembly being removed from the wellbore.

FIG. 4 is a sectional view illustrating the tool 180 and the plug assembly 100 being removed from the wellbore 10. After the logging operation is complete, the COROD string 175, tool 180 and second portion 110 are urged toward the surface of the wellbore 10 until the second portion 110 of the plug assembly 100 contacts the first portion 105. At that time, the housing 145 of the second portion 110 aligns with the lower mandrel 140 of the first portion 105. Thereafter, the plug assembly 100 comprised of the first and the second portions 105, 110 acts as one unit. As the COROD string 175 continues to be urged toward the surface of the wellbore 10, the ring member 135 disengages from the receiver member 55, thereby removing the sealing relationship between the plug assembly 100 and the instrument tube 45. Subsequently, the plug assembly 100, the tool 180 and COROD string 175 are pulled out of the wellbore 10 in the direction indicated by arrow 60. At the surface of the wellbore 10, the ring member 135 may be replaced and the plug assembly 100 may be once again transported into the wellbore 10 with another logging tool at the lower end of a COROD string.

In operation, a logging tool and a plug assembly are urged though a production tubing into a deviated wellbore on a COROD string. Generally, the plug assembly comprises a first portion and a second portion operatively connected to each other by a selectively activated release member. The logging tool and plug assembly are urged through the production tubing until the first portion of the plug assembly seats in the receiver member formed in an instrument tube at the lower end of the production tubing. As the COROD string continues to be urged downward, a force is created on the selectively activated release member. At a predetermined force, the release member is activated, thereby allowing the second portion of the plug assembly and the logging tool to move in relation to the first portion of the plug assembly which is secured in the instrument tube. Thereafter, the COROD string continues to urge the second portion along with the logging tool through the deviated portion of the wellbore to conduct a logging operation. After the logging operation is complete, the COROD string urges the logging tool and the second portion toward the surface of the wellbore until the second portion of the plug assembly contacts and aligns with the first portion. Thereafter, the plug assembly comprised of the first and the second portions acts as one unit. Subsequently, the plug assembly, the logging tool and COROD string are pulled out of the wellbore.

As described above, in order to seat the plug assembly 100 into the receiver member 55, a downward force is needed on the plug assembly 100 to ensure the receiver member 55 and the ring member 135 are mated properly. Further, a second downward force is needed to activate the release member 115. For one embodiment, the second downward force is needed to shear a plurality of pins in the release member 115 and allow the COROD string to continue traveling into the wellbore.

The downward force needs to be applied via the COROD string 175. In some deep and highly deviated wells, it may not be possible to provide the required downward force to downhole components (such as the plug assembly 100) by "pushing" the COROD string 175 (i.e., loading the COROD in compression) from the surface. A downward force can be provided, however, by managing the tension in the string 175, wherein the tension is based on the weight of the COROD string 175 extending from the surface together with the weight of any downhole components attached to the COROD string 175 (e.g., tools).

For example, referring back to FIG. 2, suppose the total weight of the string 175 and any downhole tools attached to the string 175 is 10000 lbs, and a 2500 lbs downward force is needed to properly set the plug assembly 100 in the receiver member. Accordingly, the tension in the COROD string 175 prior to the plug assembly 100 being set is 10000 lbs. In order to apply the 2500 lbs downward force when the plug assembly 100 is positioned adjacent the receiver member 55, a tension of only 7500 lbs is maintained in the COROD string 175. As a result, the remaining 2500 lbs of weight in the string 175 that has not been counteracted by tension in the string 175 provides a downward force of 2500 lbs on the plug assembly 100, thereby setting the plug assembly 100 in the receiver member 55. In the same manner, another downward force is provided to activate the release member 115. It should be noted, that in order to activate the release member 115 (e.g., shear the pins in the shear assembly), there needs to be relative movement between the first portion 105 and the second portion 110 of the plug assembly 100; in order to facilitate the relative movement, the plug assembly 100 needs to be properly anchored in the receiver member 55.

Additionally, if larger downward forces (i.e., forces greater than the weight of the string 175) are needed, they can be provided with the use of weighted members, or weight stem (not shown). As their name indicates, a weight stem can be added to the string 175 at various points above the plug assembly 100 to increase the weight of the string 175 and correspondingly increase the tension. In this manner, the desired amount of downward force can be applied by managing the weight of the string 175 and tension in the string 175.

Figure 5:
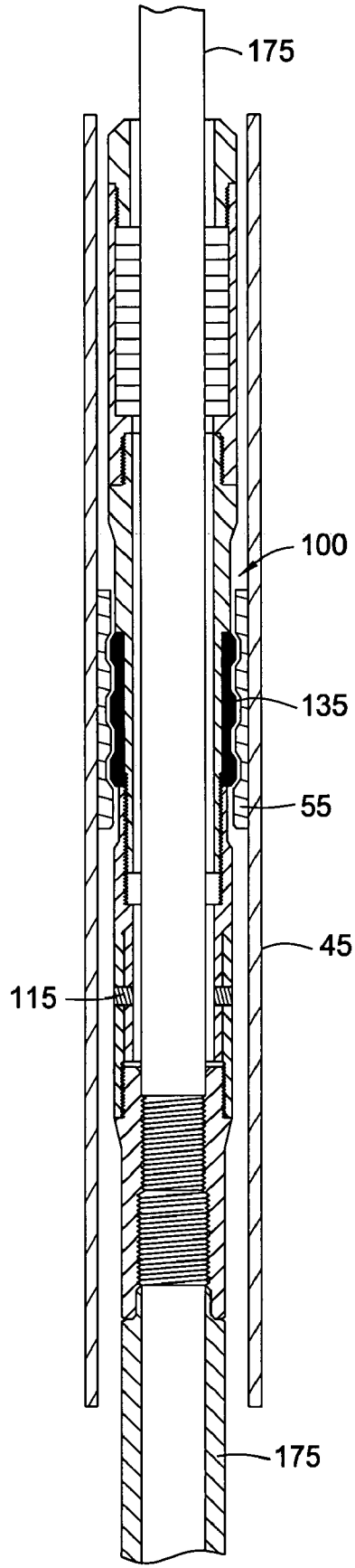
FIG. 5 is a sectional view illustrating the plug assembly, according to one embodiment of the present invention, being positioned in a receiver member.

FIG. 5 is a sectional view illustrating the plug assembly 100, according to one embodiment of the present invention, being positioned in a receiver member 55. As stated above, a certain amount of force is needed to urge the plug assembly 100 downwards so that the ring member 135 properly engages the profile of the receiver member 55. Once the plug assembly 100 is properly seated, the interface between the ring member 135 and the receiver member 55 forms a seal that prevents any pressure loss or flow of fluid via the annulus formed between the outer diameter of the plug assembly 100 and the inner diameter of the instrument tube 45.

Figure 6:
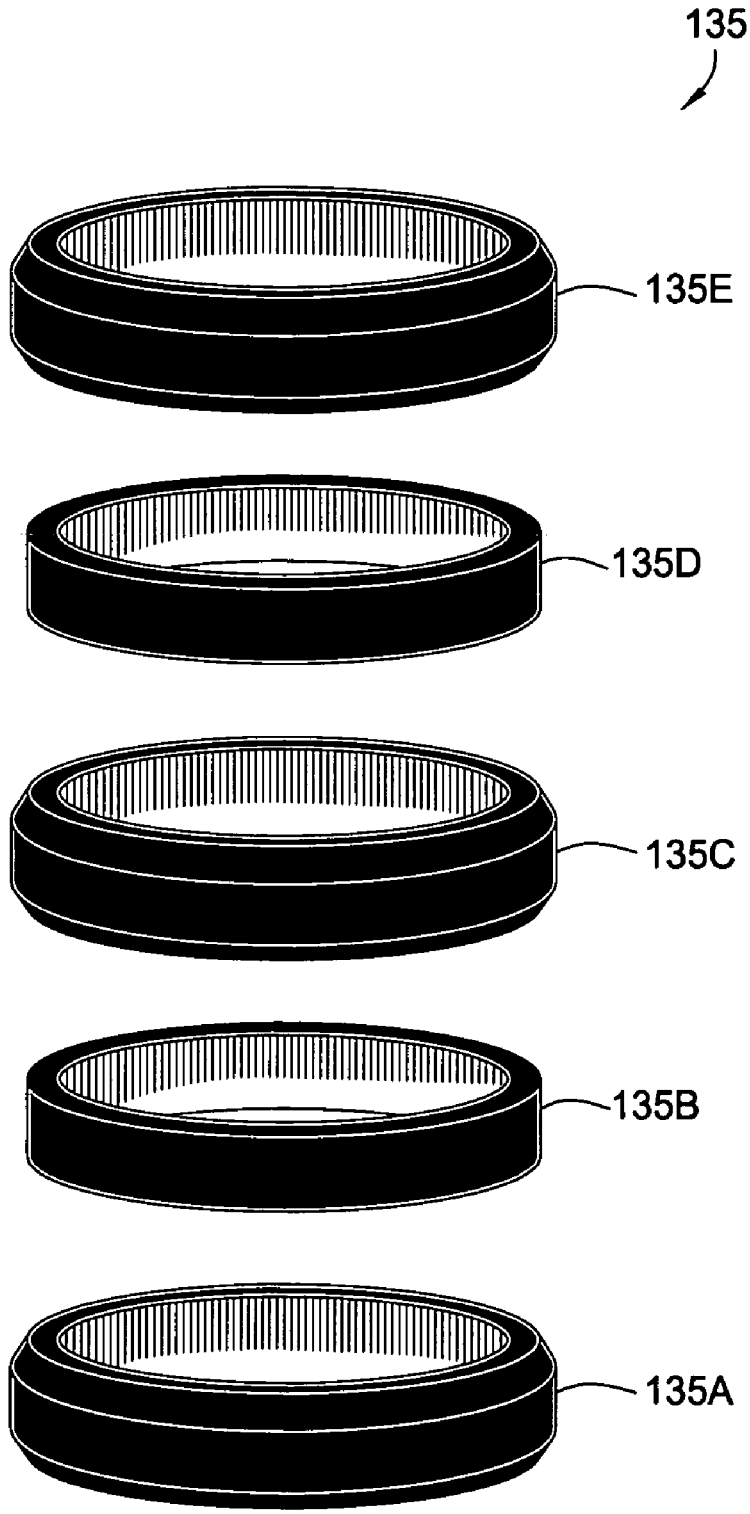
FIG. 6 is a detailed view of the ring member according to another embodiment of the present invention.

FIG. 6 is a detailed view of the ring member 135 according to one embodiment of the present invention. As shown, the ring member 135 is an assembly that comprises a plurality of rings—setting rings and spacer rings. In FIG. 6, the setting rings are denoted by reference numbers 135A, 135C and 135E, while spacer rings are denoted by reference numbers 135B and 135D. It can be seen that the setting rings have a larger outer diameter than the spacer rings. Accordingly, when all five of the rings are assembled, they form the ring member 135 with a profile as shown in FIG. 5. Setting rings and spacer rings can be arranged in a variety of ways to properly interface with a variety of receiver member profiles, such as the receiver member 55 in FIG. 5. Further, rings of various materials can be assembled into a ring member 135 to suit an application. For instance, in a high temperature application, it may be suitable to utilize rings constructed of a particular polymer blend. In some embodiments, the rings may be constructed of a particular metal or alloy.

In one embodiment, the setting rings and spacer rings are constructed and shaped such that when there is an axial force applied to the ring member 135 (e.g., as it is being forced into a corresponding receiver member 55) the axial force is translated into a transverse force that expands the setting rings into tight contact with the corresponding receiver member (shown in FIG. 5). In fact, for some embodiments, the material from which components of the ring member 135 and the receiver member 55 are constructed may require a predefined amount of axial loading to ensure a proper seal between the ring member 135 and the receiver member 55.

In order to ensure the required amount of axial load is provided, the release member 115 (shown in FIG. 5) can be configured to activate when a downward force at a particular value is provided. For instance, if an axial load of 5000 lbs is required to properly seat the ring member 135 of a particular plug assembly into the corresponding receiver member 55, the release member 115 can be configured as shear pins that are constructed to shear when subjected to a 5000 lbs axial loading. This ensures that if the release member 115 is activated, a downward force of at least 5000 lbs has been placed on the ring member 135.

For some embodiments (perhaps to facilitate precise axial positioning of the ring member 135 relative to the receiver member 55) the sizes of the setting rings may not be uniform. For instance, the setting ring positioned at the top (135E) can have a larger outer diameter than the lower setting ring (135A). Correspondingly, the receiver member 55 can be constructed with a profile to match the profile formed by the setting rings in the ring member 135. Additionally, while the ring member 135 described above comprises a plurality of setting rings of a particular shape, it should be understood that in other embodiments, ring members may comprise only one setting ring that may have one of a variety of different profiles, such as a tapered profile.

While the discussion above has focused on providing a downward force for setting the plug assembly 100 and activating the release member 115, it should be understood that embodiments of the present invention can also facilitate a downward force that can be used to activate or operate other downhole tools (e.g., pumps) located below the plug assembly 100.

Figure 7:
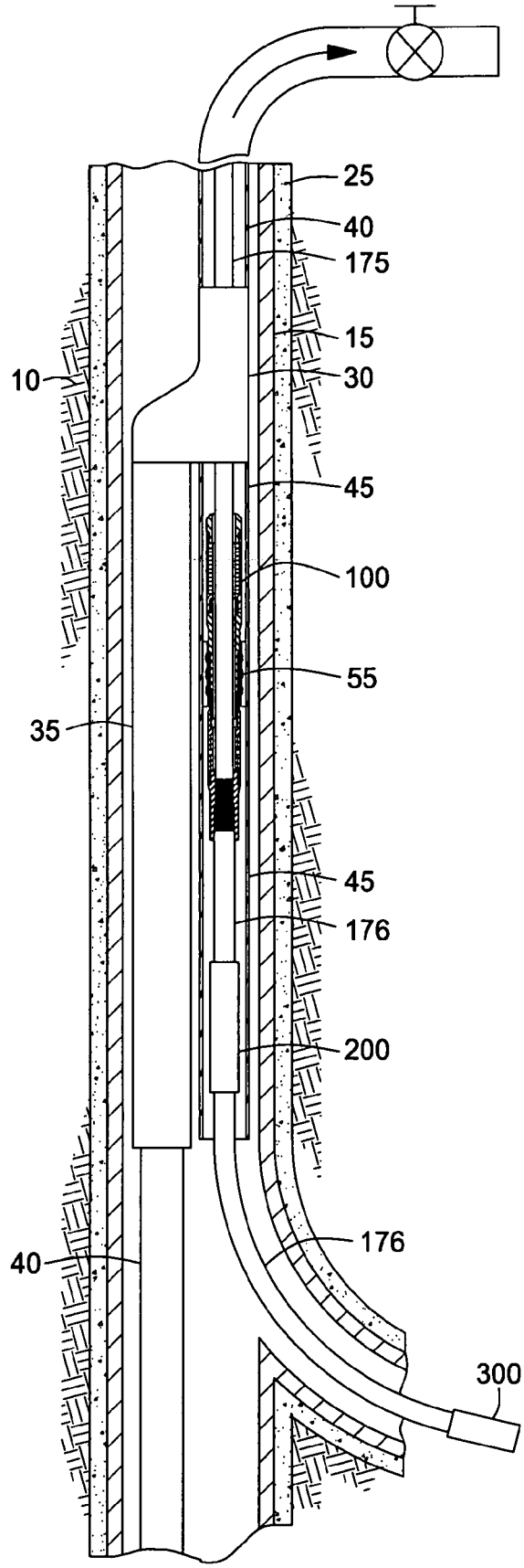
FIG. 7 is a sectional view of a plug, a pump and a packer being lowered into a wellbore on a continuous rod.

FIG. 7 is a sectional view of a plug assembly 100, a pump 200, and a packer 300 that is lowered into a wellbore on a COROD string. It can be seen that the plug assembly 100 is already anchored in the receiver member 55. Now the COROD string 175 can be reciprocated to activate the pump 200 or packer 300 below. Extension members 176 can be used to connect the plug assembly 100 to any other downhole tools below, such as the pump 200 and the packer 300. For some embodiments, the extension members 176 may be additional strings of COROD that can be of any length.

While the foregoing is directed to embodiments of the present invention, other and further embodiments of the invention may be devised without departing from the basic scope thereof, and the scope thereof is determined by the claims that follow.

The invention claimed is:

1. A method of performing an operation in a wellbore, comprising:

running a selectively separable plug member accommodating a tool into the wellbore on a continuous rod, positioning the separable plug member adjacent a receiver member disposed in the wellbore; and manipulating the weight of the continuous rod to seat the separable plug member in the receiver member.

2. The method of claim 1, wherein manipulating the weight of the continuous rod includes managing a tension in the continuous rod.

3. The method of claim 1, wherein manipulating the weight of the continuous rod includes adding weight to the continuous rod.

4. The method of claim 1, wherein the tool is a logging tool for use with in a logging operation.

5. The method of claim 1, further including sealing an annular area formed between continuous rod and the receiver member.

6. The method of claim 1, wherein the continuous rod extends from the surface of the wellbore.

7. The method of claim 1, wherein manipulating the weight of the continuous rod comprising applying an axial force on the continuous rod and moving the continuous rod downwardly, wherein the downward movement seats the separable plug member in the receiver.

8. The method of claim 1, further including manipulating the weight of the continuous rod to separate a first portion of the plug member from a second portion.

9. The method of claim 8, further including using the continuous rod to position the second portion with the tool below the first portion to perform the operation.

10. The method of claim 8, wherein the second portion and the tool are positioned in a deviated portion of the wellbore.

11. The method of claim 8, wherein the first portion is operatively attached to the second portion by a selectively activated release member.

12. The method of claim 11, wherein the selectively activated release member comprises a shearable connection.

13. The method of claim 12, wherein a predetermined axial force causes the shearable connection to fail allowing the sections to separate.

14. A method of performing an operation in a wellbore, comprising:

running a selectively actuatable plug member into the wellbore on a continuous solid rod, wherein the plug member accommodates at least one tool;

actuating the plug member by manipulating the weight of the continuous solid rod, thereby separating a first portion of the plug member from a second portion; and using the continuous solid rod to run the second portion with the at least one tool to a predetermined location below the first portion to perform the operation.

15. The method of claim 14, wherein manipulating the weight of the tubular member includes managing a tension in the tubular member.

16. The method of claim 14, wherein manipulating the weight of the tubular member includes adding weight to the tubular member.

17. The method of claim 14, further including reciprocating the tubular member to activate the at least one tool.

18. The method of claim 14, further including operatively connecting the second portion back to first portion.

19. The method of claim 18, further including removing the plug member from the wellbore.

20. A plug assembly for use in a wellbore, comprising:

a first portion configured to be attachable to a solid continuous rod, the first portion having a plurality of setting rings constructed and arranged to expand upon application of a force, wherein each pair of setting rings is interconnected via a spacer ring;

a second portion configured to accommodate at least one wellbore tool; and a selectively actuatable member for connecting the first portion to the second portion, whereby the selectively actuatable member allows the second portion to separate from the first portion upon application of a predetermined force.

21. The plug member of claim 20, wherein the selectively actuatable member comprises a shearable connection.

* * * * *